US007703356B2

(12) United States Patent
Bass

(10) Patent No.: US 7,703,356 B2
(45) Date of Patent: Apr. 27, 2010

(54) TOOL ASSEMBLY, SYSTEM AND METHOD, FOR DRIVING THREADED MEMBERS

(76) Inventor: Jamie Bass, 643 S. Odon St., Elnora, IN (US) 47529

( * ) Notice: Subject to any disclaimer, the term of this patent is extended or adjusted under 35 U.S.C. 154(b) by 29 days.

(21) Appl. No.: 12/075,504

(22) Filed: Mar. 12, 2008

(65) Prior Publication Data

US 2009/0229421 A1 Sep. 17, 2009

(51) Int. Cl.
*B25B 17/00* (2006.01)

(52) U.S. Cl. ..... 81/57.3; 81/177.8

(58) Field of Classification Search ..... 81/57.3, 81/57.29, 177.8, 57.14, 57.26, 57.42, 177.2, 81/180.1, 185.2; 403/277, 279, 297, 300, 403/301, 335

See application file for complete search history.

(56) References Cited

U.S. PATENT DOCUMENTS

| | | | | | |
|---|---|---|---|---|---|
| 1,372,113 | A | * | 3/1921 | Yaple | 81/57.3 |
| 1,875,529 | A | * | 9/1932 | Vandervoort | 81/57.3 |
| 1,957,462 | A | | 5/1934 | Kress | |
| 2,703,030 | A | | 3/1955 | Marvin | |
| 2,764,048 | A | | 9/1956 | Thompson | |
| 3,987,691 | A | * | 10/1976 | Savage | 81/57.3 |
| 4,063,475 | A | * | 12/1977 | Perkins | 81/57.22 |
| 4,485,700 | A | | 12/1984 | Colvin | |
| 4,520,697 | A | | 6/1985 | Moetteli | |
| 4,827,809 | A | * | 5/1989 | Broemel, Jr. | 81/57.3 |
| 5,178,047 | A | | 1/1993 | Arnold et al. | |
| 5,419,221 | A | | 5/1995 | Cole | |
| 5,544,553 | A | * | 8/1996 | Galat | 81/57.3 |
| 5,732,605 | A | * | 3/1998 | Mann | 81/57.3 |
| 5,775,182 | A | * | 7/1998 | Plakinger | 81/57.3 |
| 5,775,184 | A | * | 7/1998 | Cole | 81/60 |
| 5,784,934 | A | | 7/1998 | Izumisawa | |
| 5,927,156 | A | * | 7/1999 | Landwehr, III | 81/57.3 |
| 6,216,562 | B1 | * | 4/2001 | Hsieh | 81/57.29 |
| 6,260,448 | B1 | | 7/2001 | Chaconas | |
| 6,272,952 | B1 | * | 8/2001 | Hsu et al. | 81/57.22 |
| 6,647,830 | B2 | * | 11/2003 | Marquardt | 81/57.3 |
| 6,832,531 | B1 | * | 12/2004 | Marquardt | 81/57.3 |
| 6,923,094 | B1 | * | 8/2005 | Marquardt | 81/57.3 |
| 2006/0000320 | A1 | * | 1/2006 | Hutton et al. | 81/177.8 |
| 2006/0236816 | A1 | * | 10/2006 | Picou | 81/57.14 |
| 2007/0056409 | A1 | * | 3/2007 | Dickey | 81/57.3 |

* cited by examiner

*Primary Examiner*—David B Thomas
(74) *Attorney, Agent, or Firm*—Liell & McNeil

(57) ABSTRACT

A system and tool assembly for driving threaded members includes, a set of interlocking torque transfer modules for transferring a torque between a driver coupled with a first one of the modules and a threaded member coupled with a second one of the modules. At least one of the modules has a body and a torque transmitting geartrain housed within the body, the geartrain includes an input gear rotatable about a first axis and an output gear rotatable about a second, different axis. The input gear includes a first connecting interface configured to receive an input torque from a driver, and the output gear has a second connecting interface configured to output an output torque to a threaded member, such as a bolt or sparkplug.

20 Claims, 9 Drawing Sheets

TOOL ASSEMBLY, SYSTEM AND METHOD, FOR DRIVING THREADED MEMBERS

TECHNICAL FIELD

The present disclosure relates generally to tools and tool assemblies used in driving threaded members, and relates more particularly to transmitting torque from a driver to a threaded member by way of a parallel axis torque transmitting geartrain of a torque transfer module.

BACKGROUND

A great many types of tools and tool assemblies for use in driving threaded members have been developed over the years. Box end wrenches, socket wrenches, adjustable wrenches and numerous others are familiar examples. Certain designs are purpose built for driving specific types of fasteners, spark plugs and other threaded machine components. Tools may also be designed to access threaded members located in certain positions within a machine system, or configured to optimize mechanical advantage.

Despite a multiplicity of different tool designs, there are many instances where threaded members in hard-to-reach locations remain difficult to access, or require laborious disassembly of components of a machine system before the threaded members can be accessed. Transmission bell housing bolts, spark plugs and oxygen sensors are commonly threaded into a housing in difficult to reach areas of an engine system. When a technician wishes to replace a spark plug, for example, it may be necessary to remove components of an air conditioning system of an associated automobile. Even where it is physically possible to remove certain threaded members without disassembly of unrelated components, it may be uncomfortable for a technician or even dangerous.

The present disclosure is directed to one or more of the problems or shortcomings set forth above.

SUMMARY

In one aspect, a tool assembly for driving threaded members includes a driver, and a module configured to transfer torque between the driver and a threaded member. The module includes a body and a torque transmitting geartrain housed within the body, and the geartrain includes an input gear rotatable about a first axis and an output gear rotatable about a second, different axis which is parallel the first axis. The input gear has a first connecting interface configured to mate the input gear with the driver and a second connecting interface. A rotation of the input gear via the driver imparts a rotation to the output gear to drive a threaded member coupled with the module via the second connecting interface.

In another aspect, a system for use in driving threaded members includes a set of interlocking torque transfer modules for transferring a torque between a driver coupled with a first one of the modules and a threaded member coupled with a second one of the modules. At least one of the modules has a body and a torque transmitting geartrain housed within the body, the geartrain including an input gear rotatable about a first axis and an output gear rotatable about a second, different axis which is parallel the first axis. The input gear has a first connecting interface configured to receive an input torque from the driver, and the output gear has a second connecting interface configured to output an output torque.

In still another aspect, a method for driving a threaded member includes coupling a torque transfer module of a tool assembly with a threaded member, and transmitting a torque from a driver of the tool assembly to the threaded member via a geartrain of the torque transfer module. The transmitting step includes rotating an input gear of the geartrain about a first axis, and rotating an output gear of the geartrain about a second, different axis which is parallel the first axis in response to rotating the input gear.

DETAILED DESCRIPTION

Figure 1:
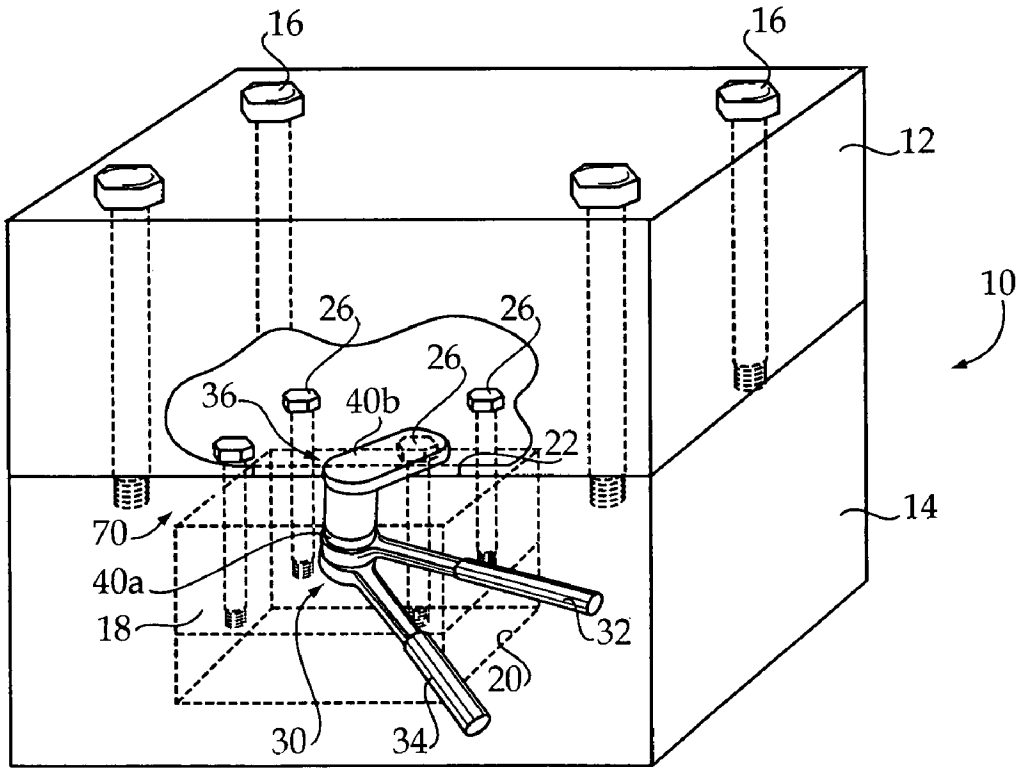
FIG. 1 is a diagrammatic view of a tool assembly for driving a threaded member, engaged with a fastener of a machine system, according to one embodiment.

Referring to FIG. 1, there is shown a machine system 10 having a first body component 12 and a second body component 14 coupled with first body component 12 by way of a plurality of fasteners 16. A third body component 18 is positioned in body component 14 and is coupled with second body component 14 with a second plurality of fasteners 16. A service opening 20 is formed in second body component 14 and allows removal of third body component 18 from second body component 14 when fasteners 26 have been disengaged from third body component 18. Machine system 10 is depicted in FIG. 1 diagrammatically, and may be any of a wide variety of machine systems, such as an engine system, an industrial process machine such as a milling machine, a grinding machine, a press, a chemical treatment machine, and many others. Machine system 10 need not even include moving parts, but could instead comprise a storage device, a household apparatus, or essentially any other conceivable system. Third body component 18 should thus be taken to represent one of many possible different machine system components. Body component 18 might be motor, a compressor, a pump, a valve system, a manifold, an electronic control unit, etc. As will be further apparent from the following description, machine system 10 is depicted herein only for the purpose of illustrating threaded members disposed in relatively difficult to access locations. To this end, fasteners 26 might not in fact be fasteners, but should be understood to represent other threaded members such as spark plugs, sensors, etc.

As mentioned above, service opening 20 can allow removal of third body component 18 when fasteners 26 are disengaged from third body component 18. With conventional fastener driving tool assemblies and systems, fasteners 26 would be difficult or impossible to access without first disassembling machine components 12 and 14. Thus, a technician may only need to access component 18 for service or replacement, or may even only need to access one or more of threaded members 26. Using conventional tools, however, the technician would be required to first disassemble components 14 and 16 before he or she could access fasteners 26. A system 30 for driving threaded members, one subject of the present disclosure, is also shown in FIG. 1 and is positioned to access fasteners 26 through an aperture 22 in first body component 12. This can allow removal of third body component 18 via service opening 20 without first disassembling components 12 and 14. The applications and manner of operation of system 30 will be further apparent from the following description.

System 30 may comprise a set 36 of torque transfer modules, including a first module 40*a* and a second module 40*b* coupled with one of threaded members 26, as shown in FIG. 1. System 30 may be part of a tool assembly 70 which includes one or more torque transfer modules, e.g. set 36, and a driver 32, 34. In the FIG. 1 embodiment, the driver may be a two-part driver comprising a first wrench 32 and a second wrench 34, further described herein. In other embodiments, a different type of driver such as a motorized driver, an electrical or pneumatic impact driver, etc., could be used. In any event, modules 40*a* and 40*b* may be extended into aperture 22 to access fasteners 26, and fasteners 26 may be driven to disengage with third body component 18. With fasteners 26 disengaged, third body component 18 can be removed for servicing, and then reinstalled in second body component 14. In this general manner, threaded members may be removed via system 30 in hard to reach places without laborious disassembly of unrelated components.

Figure 2:
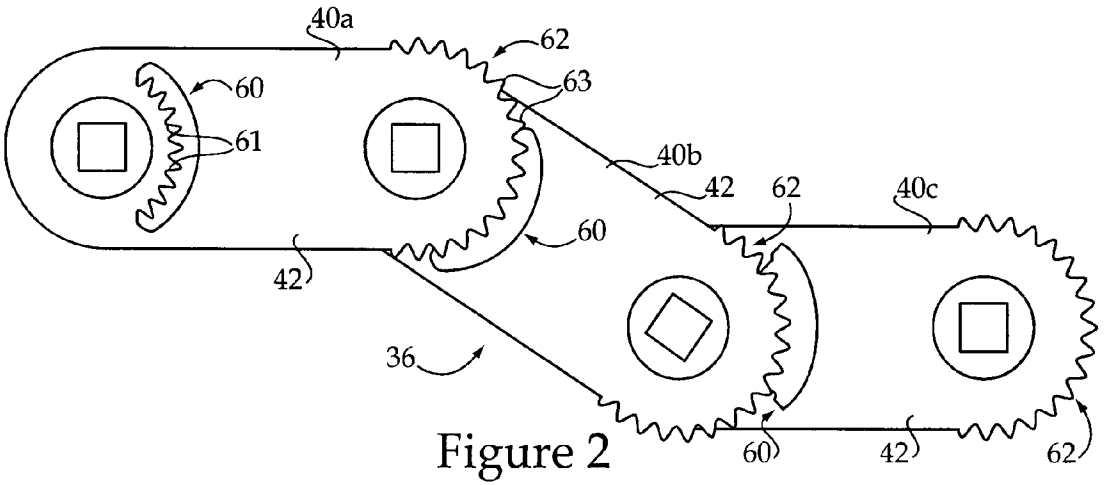
FIG. 2 is a diagrammatic view of a system for driving a threaded member according to one embodiment.

Turning now to FIG. 2, there is shown set 36 in more detail, and including a third torque transfer module 40*c*. In the example shown, modules 40*a-c* are identical. It should be appreciated that set 36 may include one, two, three or more torque transfer modules, further described herein. Furthermore, a technician may select a subset of set 36 based on a location of a threaded member to be accessed within a machine system. An example of selecting a subset of set 36 would be the selection of two torque transfer modules 40*a* and 40*b* for use in driving fasteners 26, as in FIG. 1. In this example, the relative recessing of fasteners 26 from aperture 22 may make the use of two torque transfer modules 40*a* and 40*b* appropriate. In other words, an available access pathway to a threaded member to be driven may influence or dictate the selection of a subset of torque transfer modules from set 36. In the FIG. 1 example, the access path to fasteners 26 is generally in a straight line from aperture 22. In other instances, obstructions may lie between a point of access, e.g. aperture 22, and a threaded member to be driven. Embodiments are contemplated, some of which are described herein, where set 36 includes torque transfer modules which can transfer torque along different and potentially more complex access paths than that shown in FIG. 1. Thus, a technician may select a subset of torque transfer modules which best suits a particular application, based on the available or desired access path. Similarly, specific torque transfer modules from set 36 may be assembled in an assembly pattern, assembly order or assembly configuration based on a location of a threaded member to be driven within a machine system. In still other instances, a number or type of torque transfer modules may be selected based on desired leverage or mechanical advantage. Since modules of set 36 can interlock, as described herein, a group of interlocked modules can provide a lever arm of a desired length for rotating a threaded member coupled therewith. It should be appreciated that a large number of possible configurations, using different modules having different sizes, torque transfer paths, and other features is possible in view of the teachings set forth herein. Accordingly, set 36 may include numerous different torque transfer modules, including any of the torque transfer modules shown and described herein.

Modules 40*a*, 40*b*, 40*c* and such other modules as may comprise set 36 may be interlocking to enable them to be readily held at fixed orientations relative to one another during use. To this end, each of modules 40*a-c* may include one or more anti-rotation elements 60 and 62 configured to interlock with complementary anti-rotation elements of an adjacent torque transfer module or, as further described herein, with a driver. In FIG. 2, each of modules 40*a-c* is identical, hence identical reference numerals are used to denote identical features on the respective modules. Each of modules 40*a-c* may include a module body 42 having a first anti-rotation element 60 disposed thereon at a first location, and a second anti-rotation element 62 disposed thereon at a second location which has a configuration complementary to first anti-rotation element 60. In one embodiment, first anti-rotation element 60 may have an arcuate configuration and include a set of anti-rotation teeth 61 projecting radially inward relative to axis A. First anti-rotation element 60 may be located between axis A and axis B, and the arcuate configuration of first anti-rotation element 60 may define a first arc intersecting a plane defined by axis A and axis B and having a first arc length. Second anti-rotation element 62 may also have an arcuate configuration complementary to the arcuate configuration of first anti-rotation element 60 and also include a set of anti-rotation teeth 63 which interlock with anti-rotation teeth 61 and project radially outward relative to axis B. Second anti-rotation element 62 may be located on an end of module body 42, and the arcuate configuration of second anti-rotation element 62 may define a second arc having a second arc length less than about 190° as shown in FIG. 2. The second arc length may be greater than the first arc length. It may be noted that the arcuate configuration of first anti-rotation element 60 is different from the arcuate configuration of second anti-rotation element 62. When the respective teeth 61 and 63 of adjacent anti-rotation elements 60 and 62 are interlocked, such as between modules 40*a* and 40*b* and between modules 40*b* and 40*c* in FIG. 2, the modules will be inhibited from rotating relative to one another in the plane of the page in FIG. 2. Thus, set 36 might be used to drive a threaded member as a single lever arm, providing torque amplification, although such a use is only one manner whereby set 36 can be used to drive a threaded member, as further described herein. It will be noted that interlocking of anti-rotation elements 60 and 62 may occur across a range of different relative angles between adjacent module bodies 42. In one embodiment, adjacent module bodies 42 may be located anywhere within a range of about 120 degrees relative to one another. Providing each of modules 40*a-c* with the illustrated configuration allows the entire set to interlock to maintain a fixed configuration during service, and further provides for substantial flexibility for the assembly configuration itself. For instance, modules 40*a-c* might be interlocked together in a straight line, an arc, a zigzag, etc. Additional means whereby the respective modules 40*a-c* are interlocked are also provided, as further described herein.

Figure 3:
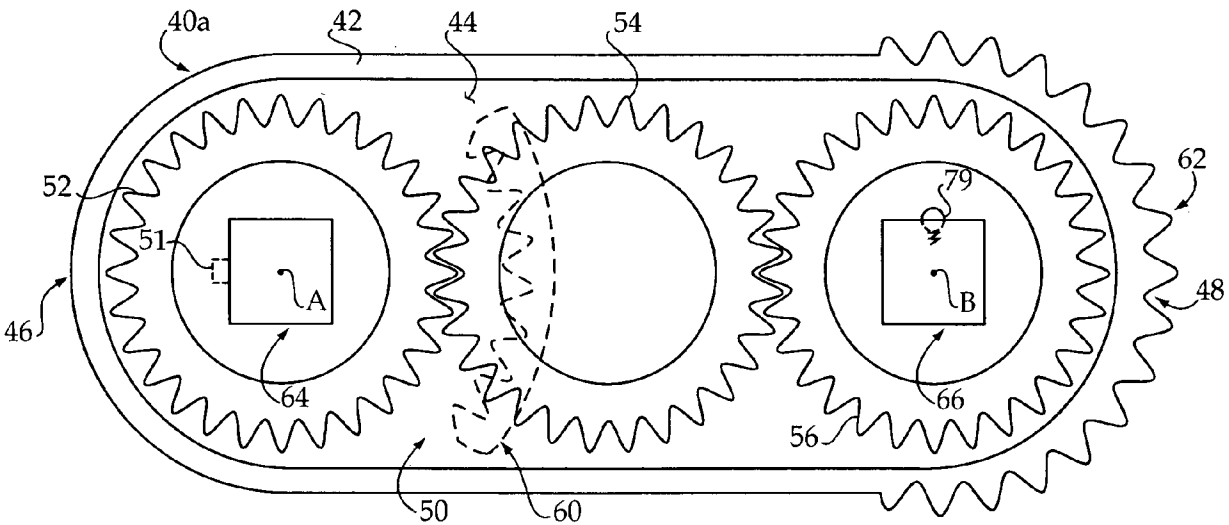
FIG. 3 is a diagrammatic view of a torque transfer module of the system shown in FIG. 2, according to one embodiment.

Turning now to FIG. 3, there is shown module 40*a* partially disassembled, illustrating an interior space 44 defined by module body 42. Module body 42 may include a first end 46 and a second, opposite end 48 whereupon anti-rotation element 62 is located. Anti-rotation element 60 may be located between first and second ends 46 and 48, and may be relatively closer to first end 46. The FIG. 3 view is opposite that of FIG. 2, hence element 60 is shown in phantom. A torque transmitting geartrain 50 may be positioned within space 44 to transmit a torque from a driver to a threaded member coupled with module 40*a*, as described herein. In certain embodiments, at least one of the modules of set 36 may include a geartrain, such as modules 40*a-c*, while other modules comprising set 36 may include torque transmitting driveshafts or other systems for transmitting torque. In all embodiments, torque transfer modules of the present disclosure will include some means for transmitting torque apart from rotation of the corresponding module body itself. Thus, while many types of wrenches and wrench attachments can transmit torque, without some means for transmitting torque apart from rotation of the wrench or attachment itself, they will not meet the definition of torque transfer module as herein intended.

Geartrain 50 may include an input gear 52 rotatable about a first axis A, a transfer gear 54 and an output gear 56 rotatable about a second axis B which is different from and parallel axis A. Since axes A and B are parallel, a torque transfer path defined by module 40*a* is a parallel axis torque transfer path. Other torque transfer modules contemplated herein include different torque transfer paths. A torque may be applied to input gear 52 via a first connecting interface 64 or input interface, transferred via a transfer gear 54 to output gear 56, then output via a second connecting interface 66 or output interface. Thus, rotation of input gear 52 imparts a responsive rotation to output gear 56. In one embodiment, interfaces 64 and 66 can serve the dual purposes of connecting module 40*a* with other components of system 30 or driver tools for system 30, and providing a means for inputting or outputting torque. First connecting interface 64 may be configured to mate input gear 52 and hence module 40*a* with a driver, whereas second connecting interface 66 may be configured to mate output gear 56 and hence module 40*a* with either of a second module or a fastener driving tool such as a socket, or could even mate output gear 56 directly with a threaded member to be driven in certain embodiments.

Each of connecting interfaces 64 and 66 may comprise a socket-type interface such as a square drive interface, with one of connecting interfaces 64 and 66 being a female socket-type interface and the other of connecting interfaces 64 and 66 being a male socket-type interface. As used herein, the term "socket-type" interface is intended to refer to the type of connecting interfaces commonly used in connection with socket wrenches, sockets for socket wrenches, and similar connecting interfaces. At minimum, a socket-type interface, as intended to be understood in the present context, will include one of, an aperture which receives an input element or an input element itself, and some means for locking engagement. Thus, a socket-type interface could include a female socket or a male driver and additionally a locking element such as a spring-loaded ball or a recess which receives a spring loaded ball.

In FIG. 3, connecting interface 64 is a female interface and includes a recess 51, whereas connecting interface 66 is a male interface and includes a spring loaded ball 79. The ball/recess implementation might be reversed in other embodiments, thus connecting interface 64 could include a spring-loaded ball, and connecting interface 66 could include a recess. Each of the connecting interfaces described herein in connection with the various torque transfer module embodiments may have one of the spring-loaded ball 51 or recess 79 elements shown in FIG. 3. Connecting interfaces 64 and 66 might also comprise the same type of interface in certain embodiments, for example both of interfaces 64 and 66 could be a female interface or both could be a male interface. In one particular embodiment, first connecting interface 64 comprises a female square drive socket-type interface configured to mate with a male square drive socket-type output element of a socket wrench or the like. Second connecting interface 66 may comprise a male square drive socket-type interface configured to mate with a female square drive socket-type interface of a socket, a female square drive socket-type interface of another torque transfer module, etc.

The illustrated configurations for first and second connecting interfaces 64 and 66 allow modules 40*a-c* to lock together in a manner similar to that known with regard to conventional socket wrench sets. In other words, a second connecting interface 66 of one of modules 40*a-c* may engage with a first connecting interface 64 of another of modules 40*a-c*, and so on. While connecting interfaces 64 and 66 are shown as square drive interfaces, in other embodiments different configurations such as hexagonal configurations might be used.

Figure 4:
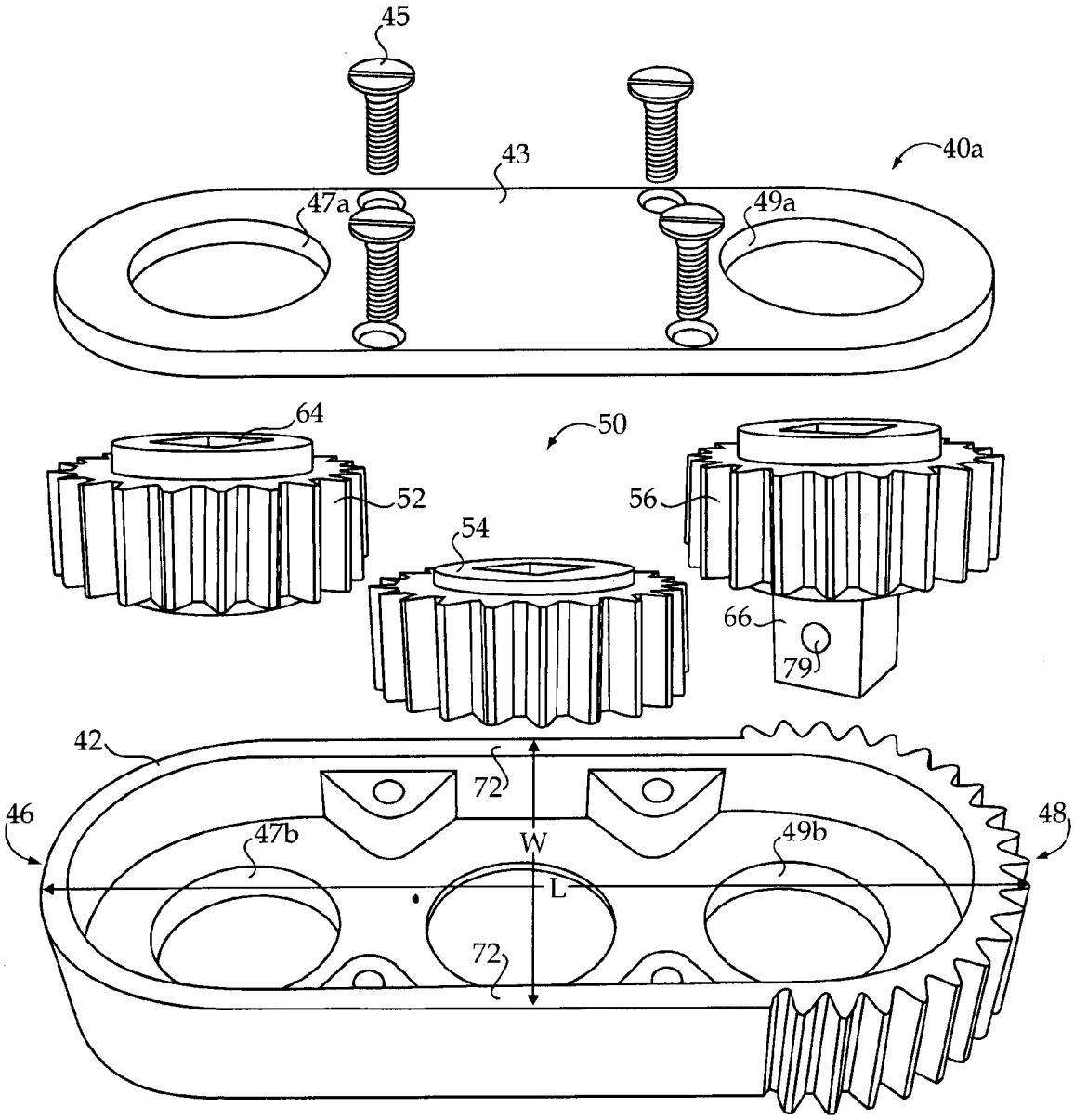
FIG. 4 is an exploded view of a torque transfer module of the system shown in FIG. 2, according to one embodiment.

Turning now to FIG. 4, there is shown an exploded view of module 40*a*. It will be noted that body 42 may comprise an elongate body having straight sides 72 and rounded on opposite ends 46 and 48. Body 42 may have a length dimension L extending between ends 46 and 48 which is at least three times a width dimension W which is perpendicular the length dimension. A thickness which is perpendicular both the length dimension and the width dimension may be less than the width dimension and may be less than one-tenth the length dimension. Body 42 may also include a substantially planar cover plate 43 having a first aperture 47*a* and a second aperture 49*a* therein. First aperture 47*a* corresponds with input gear 52 and allows access to first connecting interface 64 via another module or a driver. A third aperture 47*b* is formed in body 42 and also corresponds with input gear 52. When assembled, portions of input gear 52 may extend into apertures 47*a* and 47*b* such that apertures 47*a* and 47*b* may together rotatably journal input gear 52 when module 40*a* is assembled for service. Second aperture 49*a* corresponds with output gear 56, as does a fourth aperture 49*b* which is formed in body 42. Portions of output gear 56 may extend into apertures 49*a* and 49*b* such that apertures 49*a* and 49*b* may together rotatably journal output gear 56 when module 40*a* is assembled for service. Aperture 49*b* allows second connecting interface 66 to extend from module 42, whereas aperture 47*a* allows access to first connecting interface 64.

The exemplary square drive socket-type configurations of connecting interfaces 64 and 66 are readily apparent in FIG. 4. Also shown is spring loaded ball 79 associated with connecting interface 66 which is configured to lockingly engage with a recess in another connecting interface in a manner similar to that known from conventional socket connections in other tools. For purposes of economy, in one embodiment transfer gear 54 may be identical to input gear 52, as shown. In other embodiments, transfer gear 54 may be omitted from the design, and input gear 52 could mesh directly with output gear 56. In still other embodiments, input gear 52 may be relatively smaller than output gear 56 such that geartrain 50 serves as a torque multiplier. Embodiments are contemplated where geartrain 50 includes only two gears, as well as embodiments where more than three gears are used. Relatively longer modules might use many torque transfer gears. A set of fasteners 45 may be provided to couple cover plate 43 with body 42. It is contemplated that most or all of the components of each of the torque transfer modules described herein may be die cast steel, but might be formed by any of a variety of other known manufacturing and processing or finishing techniques.

Figure 5:
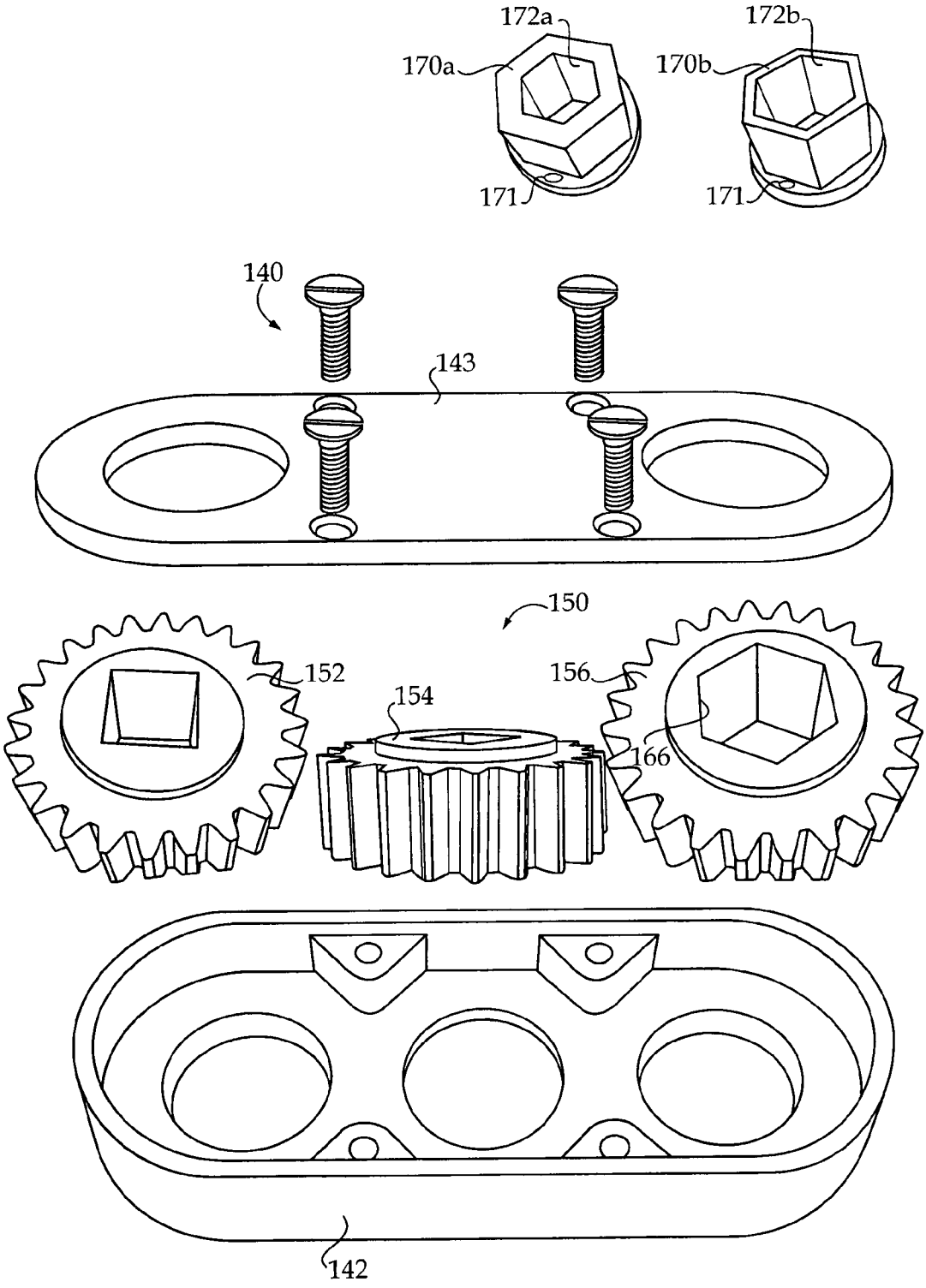
FIG. 5 is an exploded view of a torque transfer module of a system for driving a threaded member, according to one embodiment.

Turning now to FIG. 5, there is shown an exploded view of a torque transfer module 140 according to another embodiment. Module 140 is similar to module 40*a* shown in FIG. 4, but has several differences. Module 140 includes a body 142, a cover plate 143 and a torque transmitting geartrain 150 including an input gear 152, a transfer gear 154 and an output gear 156. Input gear 152 and transfer gear 154 may be identical to their counterpart components in module 40*a*, as may body 142 and cover plate 143. Output gear 156, however, may have a hexagonal connecting interface 166 to enable mating with hexagonal threaded members, such as bolts, sparkplugs, etc. In addition, a set of inserts including a first insert 170*a* and a second insert 170*b* is shown in FIG. 5 which are configured to mate with connecting interface 166. In one embodiment, each of inserts 170*a* and 170*b* may have a hexagonal configuration. Inserts 170*a* and 170*b* may also include magnets 171 of magnetic material such as iron, iron alloys or other magnetic materials to allow them to readily couple with connecting interface 166 and to be retained in gear 156. Each of inserts 170*a* and 170*b* may also have a connecting interface 172*a* and 172*b*, respectively, which comprise different sized hexagonal connecting interfaces. Thus, collectively, connecting interfaces 166, 172*a* and 172*b* may be three different sizes, allowing module 140 to be used in driving hexagonal threaded members of three corresponding different sizes. In some instances, more than two different sized inserts may be used, or no inserts may be used.

Figure 6:
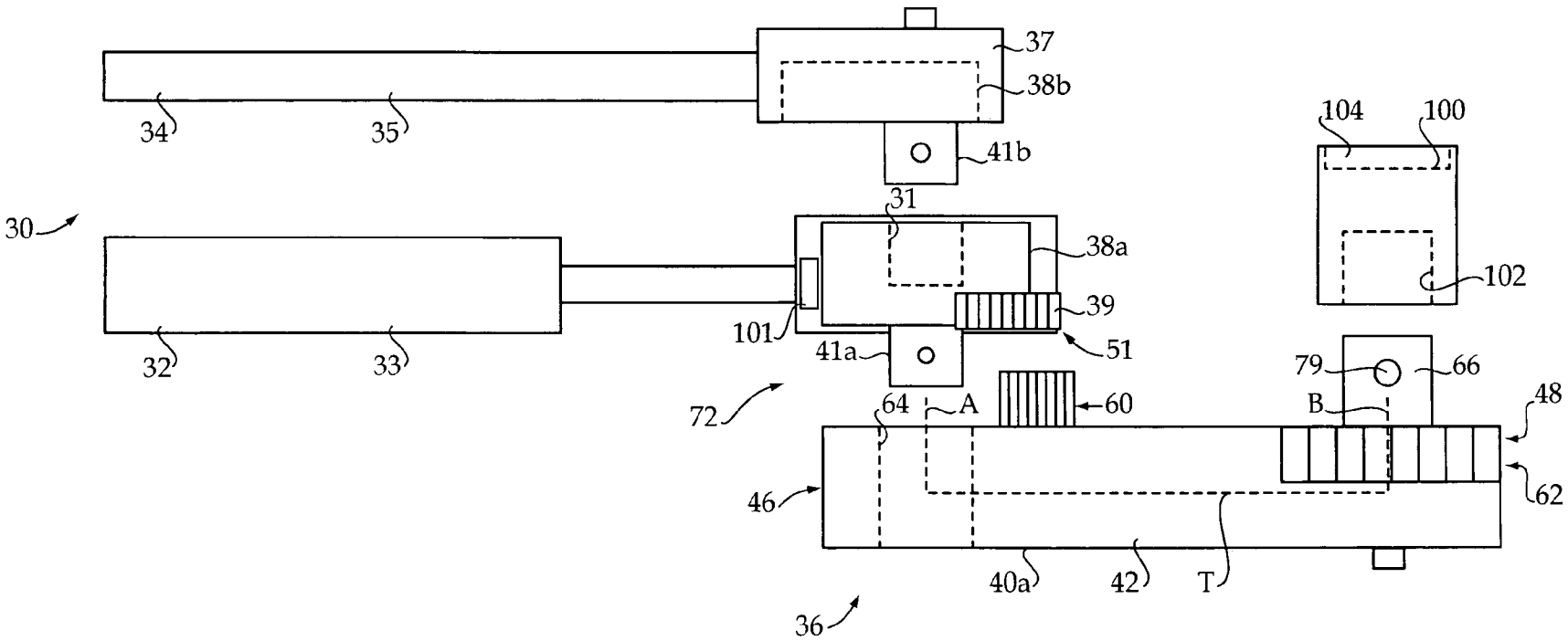
FIG. 6 is a side diagrammatic view of a tool assembly and system for driving a threaded member, according to one embodiment.

Referring to FIG. 6, there is shown a side view of tool assembly 70 illustrating the manner in which each of wrenches 32 and 34 are coupled with set 36 of torque transfer modules. In certain embodiments, only a single module might be used, and thus only module 40*a* is shown in FIG. 6. In one embodiment, wrench 32 may include a handle 33 and a head 39 coupled with handle 33. A rotatable drive element 38*a* may be disposed in head 39 and may include an input element or connecting interface 31, such as a female square drive socket-type input interface, and an output element or connecting interface 41*a* such as a male square drive socket-type output interface which is configured to mate with first connecting interface 64 of module 40*a*. An anti-rotation element 51 similar to anti-rotation element 62 of module 40*a* may be located on head 39 to enable wrench 32 to interlock with anti-rotation element 60 of module 40*a*. In designing wrench 32, the location of element 41*a* relative to anti-rotation element 51 should be designed such that the simultaneous connections between element 41*a* and connecting interface 64 and between anti-rotation elements 51 and 60 are possible. Mating of output interface 41*a* with connecting interface 64, and engaging of anti-rotation elements 51 and 60 allows wrench 62 to interlock with module 40*a*. Thus, wrench 62 may be held at a fixed angle interlocked with module 40*a*, and rotation of rotatable drive element 38*a* can impart a rotation to the input gear (not shown) of module 40*a*.

In one embodiment, rotation of drive element 38*a* may take place with another manually operable wrench, such as wrench 34. In other embodiments, a motorized wrench or other driver device might be coupled with input interface 31 to rotate drive element 38*a*. Wrench 34 may comprise a standard ratchet wrench having a handle 35, a head 37 coupled with handle 35 and another rotatable drive element 38*b*. Wrench 34 may also include an output interface 41*b* which is configured to mate with input interface 31. Also shown in FIG. 6 is a socket 100 which may be a conventional socket having an input interface 102 and an output interface 104. Input interface 102 may be configured to mate with second connecting interface 66 of module 40*a*. Output interface 104 may be configured to mate with a fastener, sparkplug, threaded sensor or any of a great many other threaded members.

Also illustrated in FIG. 6 is a torque transfer path T extending from first connecting interface 64 to second connecting interface 66. It will be recalled that module 40*a* may define a parallel axis torque transfer path, such that a first rotatable element having a first axis, the input gear of module 40*a* having axis A, transfers torque to a second rotatable element, the output gear of module 40*a*, having axis B which is parallel to axis A. In one embodiment, each of modules 40*a-c* may define identical parallel axis torque transfer paths. As alluded to above, system 30 may include additional torque transfer modules which define different torque transfer paths, as further described herein.

In one embodiment, wrench 32 may comprise a pass-through wrench 32 which allows torque to be applied via wrench 34 to drive element 38*a*, and thenceforth to module 40*a*. Drive element 38*a* thus may rotate freely to allow torque to be transferred via the torque transmitting geartrains of one or more torque transfer modules coupled with wrench 32. Since wrench 34 may be a conventional ratchet wrench, wrench 34 may be ratcheted back and forth to drive a threaded member coupled therewith via module 40*a*.

In another embodiment, wrench 32 might comprise a ratcheting mechanism 101 which engages with rotatable drive element 38*a*, rather than rotatable drive element 38*a* being free to rotate in either direction. Such an embodiment, where wrench 32 includes ratcheting mechanism 101 is contemplated for use where one or more modules 40*a* are used as a lever arm to rotate a threaded member. In such an embodiment, wrench 34 may not be used. It will be recalled that modules 40*a-c* may be rotated, apart from rotating their respective geartrains 52 to serve as a torque multiplying extension. Where wrench 32 is equipped with ratcheting mechanism 101, ratcheting mechanism 101 may serve as a ratcheting mechanism for geartrains 52 of one or more of modules 40*a*.

In other words, since ratcheting mechanism 101 may permit rotatable drive element 38*a* to rotate in a first direction, but inhibit its rotation in an opposite direction, geartrain 52 of module 40*a* may likewise be permitted to rotate in a first direction but inhibited from rotating in a second direction due to the coupling of rotatable drive element 38*a* with geartrain 52 of module 40*a*. In one particular version of an embodiment of wrench 32 which employs ratcheting mechanism 101, rotatable drive element 38*a* might include a set of external teeth (not shown) which mate with external teeth (also not shown) on ratcheting mechanism 101. Ratcheting mechanism 101 may include a set of about four teeth, and rotatable drive element 38*a* may include a set of about 36 teeth. The numbers of teeth in the respective sets can enable distribution of stress between ratcheting mechanism 101 and rotatable drive element 38*a* over a relatively greater surface area than that associated with conventional ratchet wrenches and the like. Ratcheting mechanism 101 may include a click angle of about 10 degrees in certain embodiments. Thus, where wrench 32 comprises ratcheting mechanism 101, it might be used without wrench 34 in the FIG. 1 embodiment to move set 36 of torque transfer modules 40*a* and 40*b* back and forth in aperture 22, with the entire tool assembly acting as an integrated ratcheting tool and applying a torque to the one of fasteners 26 which is a function of the length of interlocked torque transfer modules 40*a* and 40*b*, and a length of wrench 32. Using wrench 32 with wrench 34 may be understood in light of the foregoing description to be a first use configuration of system 30 whereas using wrench 32 without wrench 34 may be understood to be a second use configuration of system 30.

Figure 7:
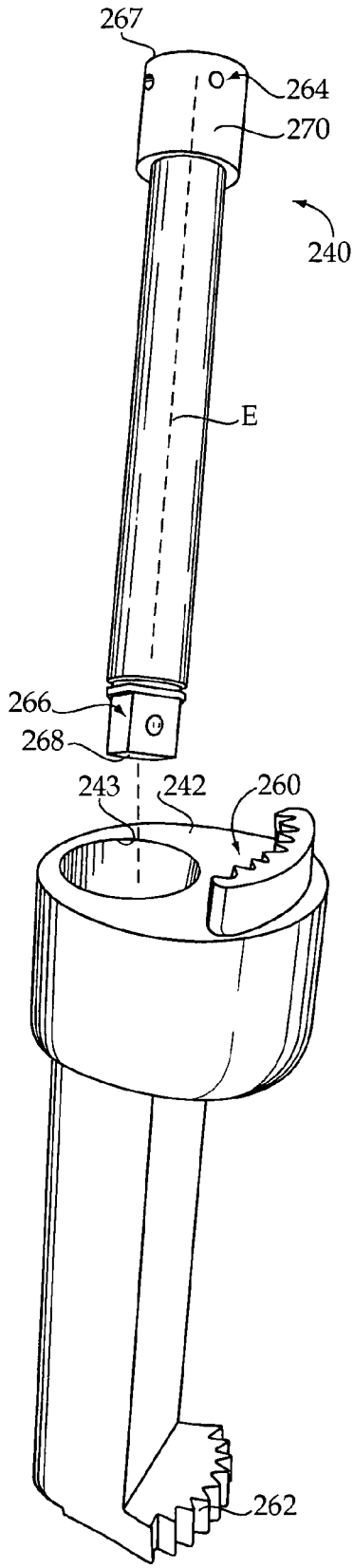
FIG. 7 is an exploded view of a torque transfer module, according to one embodiment.

Referring to FIG. 7, there is shown an exploded view of a torque transfer module 240 which comprises an extension module. Module 240 may include a body 242 which defines an elongate bore 243, and may further include a torque transmitting driveshaft 270 which is positionable within bore 243. Driveshaft 270 may have an elongate configuration and has a first end 267 and an opposite second end 268. A connecting interface 264 may be located at first end 267, and may comprise a female square drive socket-type interface configured to mate with second connecting interface 66 of module 40*a* or other torque transfer modules or a driver, as described herein. Another connecting interface 266 may be located at second end 268, and may comprise a male square drive socket-type interface. Body 242 may further include a first anti-rotation element 260 and a second anti-rotation element 262. Anti-rotation elements 260 and 262 may be similar to and have functions analogous with anti-rotation elements 60 and 62 described above in connection with module 40*a*. Anti-rotation elements 260 and 262 thus allow module 240 to interlock with other modules of system 30 in the manner described herein.

Module 240 may define a torque transfer path E which is different from the torque transfer path T defined by module 40*a*. In contrast to the parallel axis torque transfer path T, the torque transfer path E defined by module 240 may be a single axis torque transfer path corresponding to a center axis of driveshaft 270. In other words, a common axis of rotation extends through connecting interfaces 264 and 266. Accordingly, module 240 may coupled with module 40*a*, for example, by way of connecting interface 264 mating with second connecting interface 66. Connecting interface 266 may mate module 240 with a threaded member to be driven, with a socket, or with yet another module of system 30. Alternatively, module 240 might be coupled directly with driver 32. Accordingly, the elongate configuration of module 240 may provide an extension to system 30 whereby torque can be outputted to another module or applied to a threaded member at a location with is spaced from but coaxial with an output gear of a given module of system 30, such as output gear 56. For example, were module 240 coupled with module 40*a* as shown in FIG. 3 by mating connecting interface 264 with connecting interface 66, a torque output or input would be available by way of module 240 in a plane spaced from module 40*a* a distance corresponding approximately to a length of driveshaft 270 and parallel the plane of the page in FIG. 3.

Figure 8:
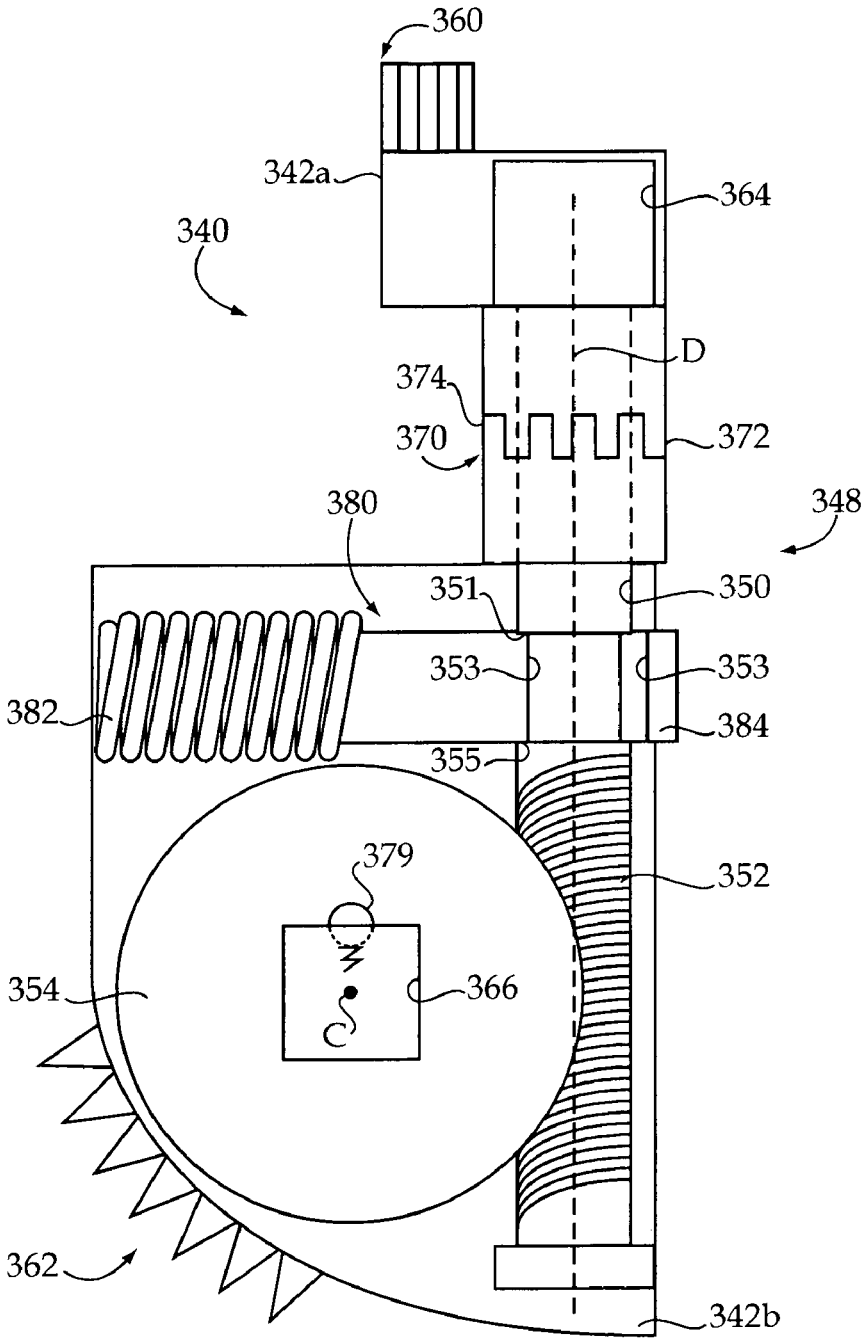
FIG. 8 is a side diagrammatic view of a torque transfer module, according to one embodiment.

Turning now to FIG. 8, there is shown another torque transfer module 340 defining yet another torque transfer path. Module 340 may include a first body component 342*a* and a second body component 342*b*. Body components 342*a* and 342*b* may be rotated relative to one another about an axis D of a threaded driveshaft 352 extending through each of body components 342*a* and 342*b* and disposed within a bore 350. A locking mechanism 370 which includes a first set of teeth 372 on first body component 342*a* and a second set of teeth 374 on second body component 342*b* may be provided to lock body components 342*a* and 342*b* at a desired angle relative to one another. A keeper mechanism 380 having a pin 384 and a biasing member 382 may be provided which inhibits disengaging of locking mechanism 370. To adjust the relative radial positions of body components 342*a* and 342*b*, pin 384 may be moved against a bias of biasing member 382, to the left in the FIG. 6 illustration. Moving pin 384 to the left can then allow body components 342*a* and 342*b* to be pulled away from one another at locking mechanism 370 to disengage teeth 372 and 374 such that body components 342*a* and 342*b* can be rotated relative to one another. Body components 342*a* and 342*b* can then be re-engaged at locking mechanism 370 and pin 384 allowed to retract via the bias of biasing member 380 to a location at which it once again inhibits disengaging of body components 342*a* and 342*b* at locking mechanism 370.

In one embodiment, keeper mechanism 380 may include a channel or bore 353 and a retaining element 355 adjacent bore 353. When keeper mechanism 380 is in a locked position, retaining element 355 fits within an annulus 351 or other feature on driveshaft 352. When retaining element 355 is within annulus 351, driveshaft 352 is not movable relative to pin 384. When pin 384 is moved to the left, to an unlocked position, retaining element 355 may be moved out of engagement in annulus 351 such that bore 353 is centered on axis D. In this configuration, housing portions 342*a* and 342*b* may be moved away from one another to disengage locking element 370. It should be appreciated that a variety of other strategies might be used in place of locking mechanism 170 and keeper mechanism 380 without departing from the full and fair scope of the present disclosure.

Module 340 may further include a connecting interface 364 on driveshaft 352 and another connecting interface 366 which have configurations and functions similar to those described in connection with other torque transfer modules herein. A spring loaded ball 379 is shown associated with connecting interface 366. Connecting interface 364 may include a recess, dimple, etc. to receive a spring loaded ball or the like associated with a connecting interface of a driver or another torque transfer module coupling with module 340. Module 340 may also include a first anti-rotation element 360 and a second anti-rotation element 362 which also have configurations and functions similar to those described in connection with other modules herein. The torque transfer path defined by module 340 may be understand as a perpendicular axis torque transfer path which is defined in particular by an axis of rotation D of driveshaft 352, and an axis of rotation C of an output gear 354 whereupon connecting interface 366 is located. Driveshaft 352 and output gear 354 may together comprise a screwdrive 348 which transmits torque between connecting interface 364 and connecting interface 366. Thus, a rotation of driveshaft 352 about first axis D imparts a responsive rotation to output gear 354 about second axis C which is perpendicular to axis D. When used with other modules or a driver of tool assembly 70, torque may be transmitted through a working angle of 90 degrees with module 340. Adjusting the positions of body components 342*a* and 342*b* allows the orientation of axis C to be varied about 360 degrees relative to axis D.

Figure 9A:
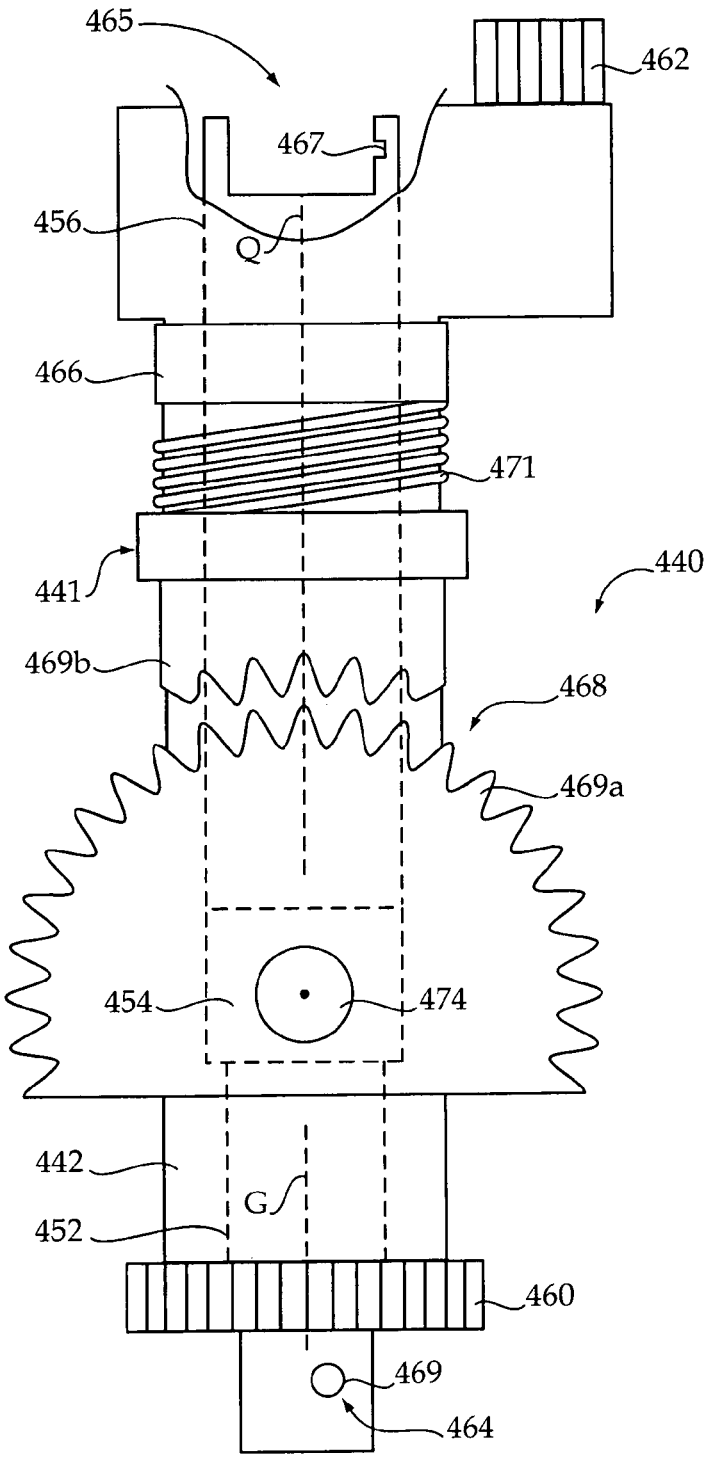
FIG. 9*a* is a side diagrammatic view of a torque transfer module, according to one embodiment.

Referring now to FIG. 9*a*, there is shown another torque transfer module 440 which may be used in tool assembly 70 of FIG. 1 in connection with other modules of system 30, as may any of the torque transfer modules described herein. Torque transfer module 440 includes a connecting interface 464 having a spring loaded ball 469 and another connecting interface 465 having a recess 467, each of which may have a configuration and function similar to those of modules already described herein. In addition, module 440 may include anti-rotation elements 460 and 462, also having a configuration and function similar to those of modules already described herein. Module 440 may also include a module body 441 including a housing portion 466 having therein a first driveshaft 456, or input shaft. Module body 441 may include another housing portion 442 having therein a second driveshaft 452, or output shaft.

A gearbox 454 is provided which is configured to transfer torque at a range of angles between driveshafts 452 and 456. Driveshaft 452 may include an axis of rotation G, whereas driveshaft 456 may include an axis of rotation Q. Driveshafts 452 and 456 may be positionable at a range of angles relative to one another, such that axes G and Q are also positionable at a range of angles relative to one another. Gearbox 454 may thus provide a variable angle coupling between driveshafts 456 and 452. Module 441 may also include a locking mechanism 468 which is configured to lock housing portions 466 and 442 at any of a plurality of angles relative to one another to position driveshafts 456 and 452 at corresponding angles. When housing portions 456 and 452 are locked at a given angle with locking mechanism 468, torque applied at one of connecting interfaces 465 and 464 can be transmitted via a torque transfer path defined by axes Q and G to the other of connecting interfaces 465 and 464. In one embodiment, locking mechanism 468 may comprise a first toothed element 469*a* which is coupled with housing portion 442, and a second toothed element 469*b* which is coupled with housing portion 466. A biaser 471 is positioned between toothed element 469*b* and an element of housing portion 466 and biases toothed portion 469*b* toward toothed portion 469*a*. Hence, the respective parts of locking mechanism 468 may be separated and housing portions 442 and 466 adjusted to different relative angles, the toothed portions 469*a* and 469*b* re-engaged and module 440 fixed at a configuration having a desired angle between axes G and Q.

Figure 9B:
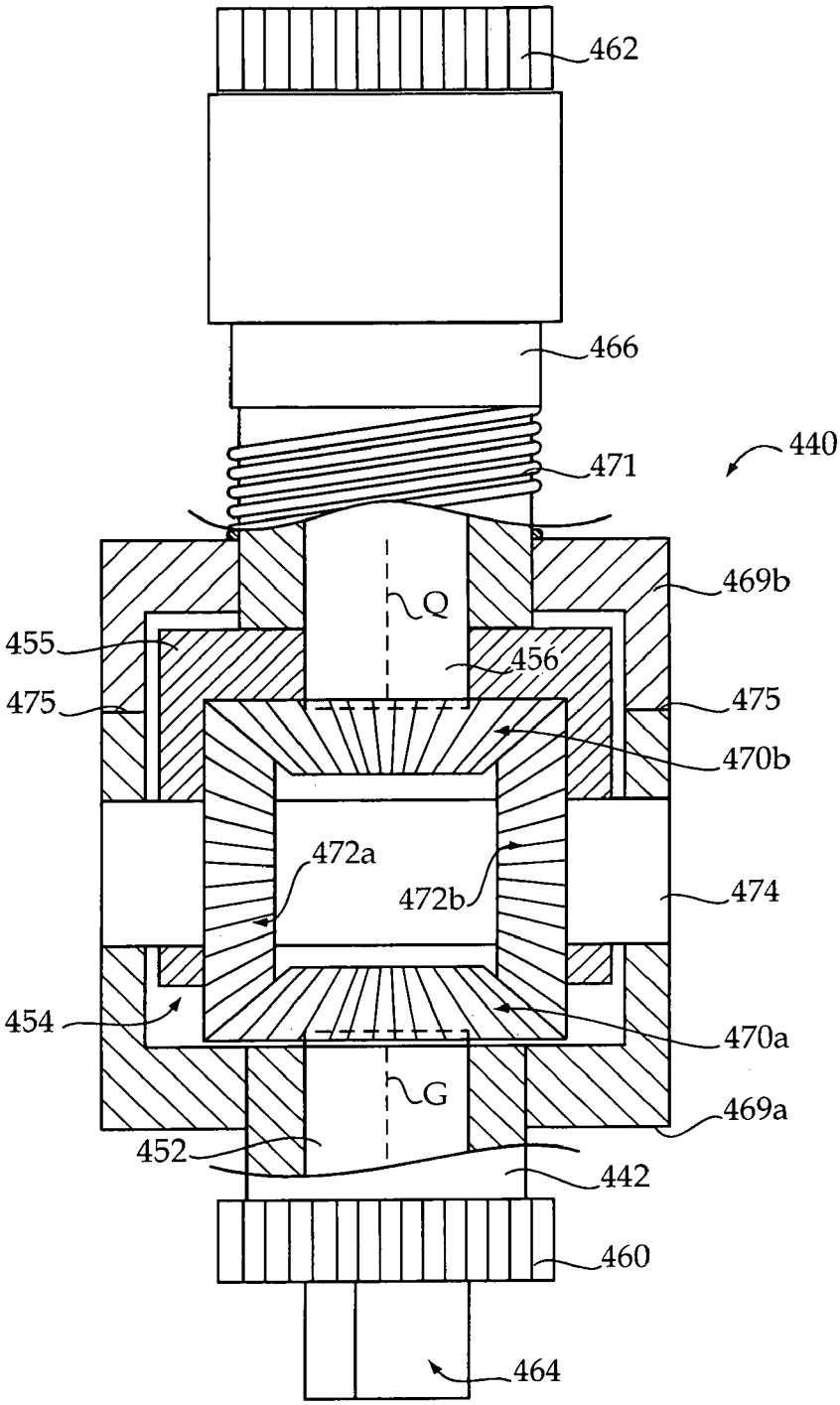
FIG. 9*b* is a partially sectioned side diagrammatic view of the torque transfer module of FIG. 9*a*, rotated approximately 90 degrees relative to the FIG. 9*a* illustration.

Referring now to FIG. 9*b*, gearbox 454 may include a first gear 470*a* comprising an output gear coupled with driveshaft 452, a second gear 470*b* comprising an input gear coupled with driveshaft 456 and a set of transfer gears 472*a* and 472*b*, which can transfer torque between driveshafts 452 and 456. Gearbox 454 may further include a support element 455 supporting a shaft 474 whereupon transfer gears 472*a* and 472*b* are positioned. Support element 455 may be coupled with housing portion 466 and configured to pivot relative to housing portion 442. Driveshaft 456 may be coupled to move with housing portion 466, such that driveshaft 456 pivots in and out of the page in the FIG. 9*b* illustration relative to driveshaft 452, positioning axis Q at a range of angles relative to axis G, and defining a variable angle torque transfer path therewith. Gearbox 454 is configured to transmit torque across the same range of angles. Toothed elements 469*a* and 469*b* may mate at an interface 475 to lock housing portions 466 and 442 at a selected angle relative to one another.

INDUSTRIAL APPLICABILITY

Referring to the drawings generally, when a technician wishes to drive a threaded member, such as a threaded member positioned in a hard to reach location in a machine system, he or she may select a subset of torque transfer modules of set 36. As discussed above, set 36 may include several identical modules, which may be thought of as "standard" modules as shown in FIG. 1. One or more standard modules such as modules 40*a-c* may be used, for example, where a threaded member to be driven is recessed from an opening, positioned relatively deeply between closely spaced walls, or in any of a variety of other scenarios. Set 36 may also include non-standard modules, such as those described in connection with FIGS. 7, 8 and 9 which can facilitate access to hard to reach threaded members in still other scenarios. It will be appreciated that any one module 40*a-c*, 240, 340, 440 may be assembled with any one or two other modules 40*a-c*, 240, 340, 440. Further, any one of modules 40*a-c*, 240, 340 or 440 may couple with a driver such as wrench 32 to be used as the sole module of tool assembly 70, or to transfer torque from the driver to another module 40*a-c*, 240, 340, 440.

When a technician has selected an appropriate subset of modules 40*a-c*, 240, 340, 440, the selected modules may be coupled together in a desired assembly configuration. It will be recalled that the anti-rotation elements 60, 62, 260, 262, 360, 362, 460, 462 can allow modules 40*a-c*, 240, 340, 440 to be interlocked with one another in many different configurations, with a selected configuration being tailored to a location of a threaded member within a machine system. A driver 32, 34 may be also be coupled with the selected subset of modules to complete assembly of tool assembly 70, prior to or after coupling one of modules 40*a-c*, 240, 340, 440 with a threaded member to be driven, such as via a socket. Torque is then applied to the coupled together modules with the driver, transmitted through the modules and applied to the threaded member.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

I claim:

1. A tool assembly for driving threaded members comprising:

a driver;

a module configured to transfer torque between the driver and a threaded member, the module having a body including a first body end, a second body end and a torque transmitting geartrain housed within the body;

wherein the torque transmitting geartrain includes an input gear rotatable about a first axis and an output gear rotatable about a second, different axis which is parallel the first axis, the first axis and the second axis defining a plane and the module further including at least one transfer gear positioned between the input gear and the output gear and being rotatable about a third axis which is parallel the first axis and the second axis, the input gear having a first connecting interface configured to mate the input gear with the driver, and the output gear having a second connecting interface;

wherein a rotation of the input gear via the driver imparts a rotation to the output gear to drive a threaded member coupled with the module via the second connecting interface;

wherein the module further includes a first anti-rotation element which is located between the first axis and the second axis and includes a first arcuate configuration defining a first arc intersecting the plane and having a first arc length;

wherein the module further includes a second anti-rotation element which is located on the second body end and includes a second arcuate configuration defining a second arc having a second arc length, wherein the second arc length is less than about 190° and is greater than the first arc length, and the second arcuate configuration being different from the first arcuate configuration and complementary to the first arcuate configuration.

2. The tool assembly of claim 1 wherein the module is a first module, the tool assembly further comprising a second module configured to transfer torque between the first module and the threaded member, the second module being configured to mate with the first module at least in part via the second connecting interface.

3. The tool assembly of claim 2 wherein the first connecting interface and the second connecting interface comprise socket-type interfaces.

4. The tool assembly of claim 3 wherein the at least one transfer gear is disposed between and meshes with the input gear and the output gear.

5. The tool assembly of claim 1 wherein the first anti-rotation element includes a first set of anti-rotation teeth projecting radially inward relative to the first axis, and a second anti-rotation element having a second set of anti-rotation teeth projecting radially outward relative to the second axis.

6. The tool assembly of claim 1 wherein the driver comprises a two-part driver including a first wrench which includes a pass-through wrench having a third anti-rotation element whereby the pass-through wrench is configured to interlock with the module and a rotatable drive element configured to mate with the first connecting interface, and a second wrench configured to mate with the rotatable drive element of the first wrench for applying a torque to the rotatable drive element.

7. The tool assembly of claim 1 wherein the driver further includes a third anti-rotation element configured to interlock with one of the first anti-rotation element and the second anti-rotation element of the module, a rotatable drive element for applying a torque to the input gear and a ratcheting mechanism coupled with the rotatable drive element.

8. A system for use in driving threaded members comprising:

a set of interlocking torque transfer modules for transferring a torque between a driver coupled with a first one of the modules and a threaded member coupled with a second one of the modules, at least one of the modules having a body and a torque transmitting geartrain housed within the body;

wherein the torque transmitting geartrain includes an input gear rotatable about a first axis and an output gear rotatable about a second, different axis which is parallel the first axis;

wherein the input gear has a first connecting interface configured to receive an input torque from the driver, and wherein the output gear has a second connecting interface configured to output an output torque;

wherein each of the interlocking torque transfer modules includes a first anti-rotation element having a first set of anti-rotation teeth for inhibiting relative rotation between the corresponding torque transfer module and one of, another torque transfer module or a driver of the system, the first set of anti-rotation teeth being arranged in an arcuate configuration defining a first arc having a first arc length; and wherein each of the interlocking torque transfer modules further includes a second anti-rotation element having a second set of anti-rotation teeth for inhibiting relative rotation between the corresponding torque transfer module and one of, another torque transfer module or a driver of the system, the second set of anti-rotation teeth being arranged in an arcuate configuration defining a second arc having a second arc length less than about 190° and being greater than the first arc length.

9. The system of claim 8 wherein the set of torque transfer modules comprises a set of torque transfer modules having among them a plurality of different assembly configurations.

10. The system of claim 9 wherein the first connecting interface comprises one of a male socket-type interface and a female socket-type interface, and wherein the second connecting interface comprises the other of a male socket-type interface and a female socket-type interface.

11. The system of claim 10 wherein the first connecting interface comprises a female square drive interface, and wherein the second connecting interface comprises a male square drive interface.

12. The system of claim 11 wherein each of the torque transfer modules comprises a first anti-rotation element and a second anti-rotation element having a configuration which is complementary to a configuration of the first anti-rotation element.

13. The system of claim 12 wherein the set of interlocking torque transfer modules includes at least two identical torque transfer modules defining identical parallel axis torque transfer paths, and wherein the system comprises another torque transfer module defining a different torque transfer path.

14. The system of claim 13 wherein the another torque transfer module comprises an extension module defining a single axis torque transfer path, the extension module including an elongate body defining a bore and a driveshaft disposed within the bore which has a first end with a third connecting interface configured to mate the extension module with the second connecting interface and a second end having a fourth connecting interface.

15. The system of claim 13 wherein the another torque transfer module comprises a screwdrive defining a perpendicular axis torque transfer path, the screwdrive including a drive shaft having an axis of rotation and a third connecting interface configured to mate with the second connecting interface, and an output gear having a fourth connecting interface and another axis of rotation which is perpendicular the axis of rotation of the driveshaft;

the another torque transfer module further including a first body component wherein the driveshaft is positioned, a second body component wherein the output gear is positioned and a locking mechanism having a locked state at which the second body component is rotatable relative to the first body component about the axis of rotation of the drive shaft and an unlocked state at which the second body component is not rotatable relative to the first body component about the axis of rotation of the driveshaft.

16. The system of claim 13 wherein the another torque transfer module comprises an adjustable torque transmission assembly defining a variable angle torque transfer path, the adjustable torque transmission assembly including an input shaft having a third connecting interface for mating the another module with the second connecting interface, and an output shaft positionable at a range of angles relative to the input shaft and having a fourth connecting interface, the second module further including a gearbox coupling the input shaft with the output shaft and being configured to transmit torque from the input shaft to the output shaft across the range of angles.

17. A method for driving a threaded member comprising the steps of:

coupling a first torque transfer module of a tool assembly with a threaded member;

coupling a second torque transfer module of the tool assembly with the first torque transfer module;

transmitting a torque from a driver of the tool assembly to the threaded member via rotating gears in a geartrain of the first torque transfer module, when the tool assembly is in a first use configuration;

wherein the step of transmitting a torque via rotating gears in the geartrain includes rotating an input gear of the geartrain about a first axis, and rotating an output gear of the geartrain about a second, different axis which is parallel the first axis, in response to rotating the input gear;

transmitting a torque from the driver to the threaded member without rotating gears in the geartrain of the torque transfer module, when the tool assembly is in a second use configuration; and inhibiting relative rotation between the first torque transfer module and the second torque transfer module at least in part via a first anti-rotation element of the first torque transfer module which includes a first arcuate configuration and a second anti-rotation element of the second torque transfer module which includes a second arcuate configuration different from and complementary to the first arcuate configuration;

wherein the first anti-rotation element is located between the first axis and the second axis and intersects a plane defined by the first axis and the second axis, and the second anti-rotation element is located on an end of the second torque transfer module; and wherein the first arcuate configuration defines a first arc having a first arc length and the second arcuate configuration defines a second arc having a second arc length which is less than about 190° and is greater than the first arc length.

18. The method of claim 17 further comprising a step of mating a socket-type output interface of the driver with a socket-type input interface of the input gear.

19. The method of claim 18 wherein the coupling step further comprises a step of mating a socket-type output interface of the torque transfer module with a socket.

20. The method of claim 18 further comprising the steps of assembling a subset of a set of torque transfer modules of the tool assembly prior to the step of transmitting a torque, and selecting the subset from the set of torque transfer modules based at least in part on a position of the threaded member within a machine system housing.

* * * * *